US006877741B2

(12) United States Patent
Polidoro et al.

(10) Patent No.: US 6,877,741 B2
(45) Date of Patent: Apr. 12, 2005

(54) METHOD AND APPARATUS FOR ALIGNING A BANKNOTE

(75) Inventors: Roberto Polidoro, Geneva (CH); Guillermo Garcia, Geneva (CH)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 10/316,782

(22) Filed: Dec. 11, 2002

(65) Prior Publication Data

US 2003/0116909 A1 Jun. 26, 2003

(30) Foreign Application Priority Data

Dec. 20, 2001 (EP) ..... 01310716

(51) Int. Cl.[7] ..... B65H 9/16
(52) U.S. Cl. ..... 271/251
(58) Field of Search ..... 271/225, 226, 271/248, 251; 101/420; 198/688.1

(56) References Cited

U.S. PATENT DOCUMENTS 3,977,779 A * 8/1976 Brooke ..... 399/318
4,184,673 A 1/1980 Weisbach
5,140,166 A 8/1992 Gerlier
5,697,609 A * 12/1997 Williams et al. ..... 271/228
5,913,268 A * 6/1999 Jackson et al. ..... 101/420
2002/0074718 A1 * 6/2002 Schlageter ..... 271/227

FOREIGN PATENT DOCUMENTS

| | | |
|---|---|---|
| EP | 0 431 267 A | 6/1991 |
| EP | 0 577 928 A | 1/1994 |
| GB | 2 054 535 A | 2/1981 |
| GB | 2 293 368 | 3/1996 |

* cited by examiner

*Primary Examiner*—Donald P. Walsh
*Assistant Examiner*—Kenneth W. Bower
(74) *Attorney, Agent, or Firm*—Fish & Richardson P.C.

(57) ABSTRACT

Manually-insert banknotes are aligned by using a fan to reduce the air pressure above a banknote so that it is pulled into engagement with a drive means which drives the edge of the banknote to a guide, causing the banknote to rotate until the edge is aligned with the guide.

10 Claims, 5 Drawing Sheets

METHOD AND APPARATUS FOR ALIGNING A BANKNOTE

This invention relates to the handling of banknotes or other sheets of value, which are herein referred to simply as banknotes or bills.

It is common in apparatus for handling banknotes to include an arrangement for aligning the banknotes so that they adopt a predetermined orientation and/or lateral position. This is particularly valuable in apparatus in which the banknotes are inserted manually and/or where different sized banknotes are handled and/or where the banknotes are tested by sensors which expect the banknote to be in a particular relative position.

Various techniques have been used for achieving banknote alignment. See for example EP-A-0 431 267, EP-A-0 577 928 and GB-A-2293368. One known technique involves driving the banknote towards a lateral guide so that, when the edge of the banknote engages the guide, the banknote rotates about an axis perpendicular to its plane to bring the edge into alignment with the guide. One problem with such an arrangement is that there is resistance to the rotational movement of the banknote. Various techniques have been devised to avoid this problem, for example by using an eccentric roller for driving the banknote, so that the driving motion is intermittent.

It would be desirable to provide a simple yet more reliable technique for alignment of banknotes.

Aspects of the present invention are set out in the accompanying claims.

According to a further aspect of the invention, air pressure is used to cause a banknote to engage a drive means which causes the banknote to rotate. For example, the drive means may drive the banknote so that an edge of the banknote engages a lateral guide which causes the banknote to turn until the edge is aligned with the guide. By using air pressure, and preferably relatively weak air pressure extending over a relatively large area of the banknote, there is little resistance to rotation of the banknote so that alignment can take place rapidly and reliably.

In a preferred embodiment, a fan is used to produce low-strength suction over a relatively large area in order to attract a face of the banknote into engagement with a drive means. A sensor is provided to detect the presence of a manually-inserted banknote and in response thereto to activate the drive means and/or the fan. The drive means rotates the banknote, preferably by driving it against a lateral guide, the banknote is thus rotated into alignment and further sensors detect the aligned condition of the banknote. This may cause the opening of a gate which allows a transport mechanism to shift the banknote away from the aligning mechanism.

The invention is particularly applicable to banknote handling apparatus which includes a banknote validator receiving banknotes manually inserted and aligned by the alignment mechanism.

An arrangement embodying the invention will now be described by way of example with reference to the accompanying drawings, in which.

Figure 1:
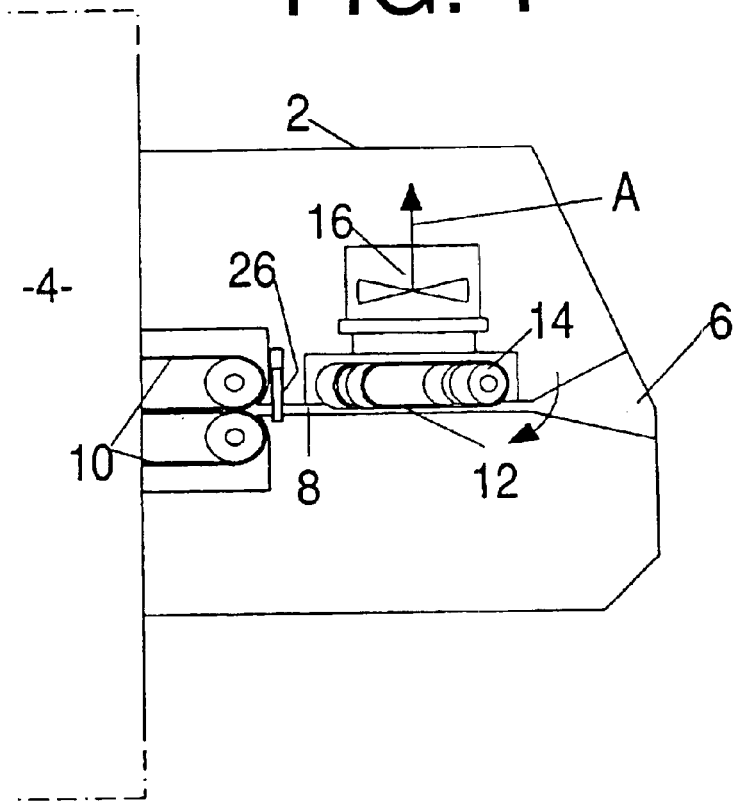
FIGS. 1, 5 and 6 are schematic side views of an alignment apparatus in accordance with the invention, showing various stages of operation.

Referring to FIG. 1, this schematically illustrates an inlet 2 of a banknote handling apparatus 4 including a banknote validator (not shown). The inlet 2 has a relatively wide mouth 6 for receiving manually-inserted banknotes. The mouth 6 leads to a narrow passageway 8 for receiving the banknotes in a generally horizontal plane. The path 8 leads to a set of drive belts 10 forming a transport mechanism for conveying a received banknote to the banknote validator.

Figure 2:
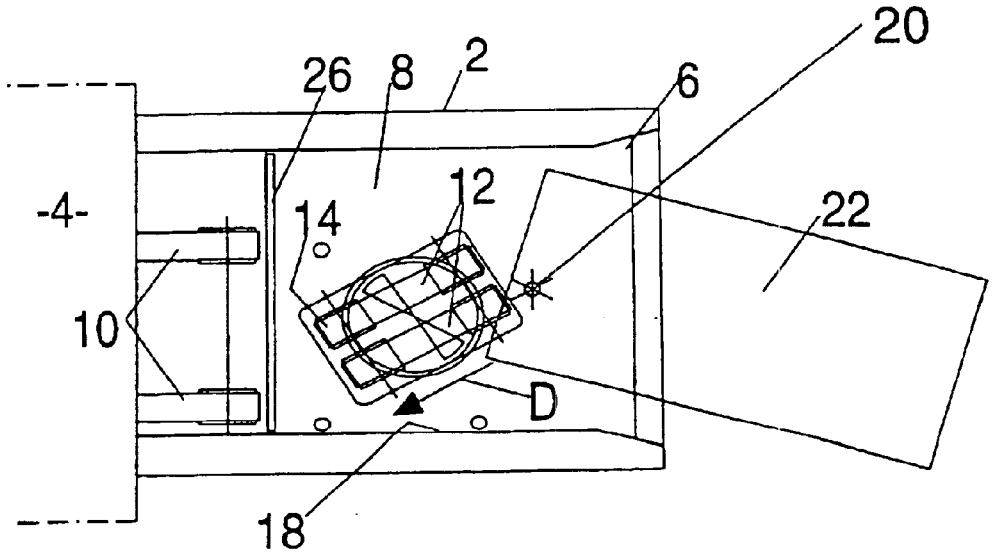
FIGS. 2 to 4 are plan views of the apparatus showing various stages of operation.

A pair of alignment belts 12 are located above the passageway 8, each belt being an endless belt extending around rollers 14 and arranged so that a drive motor (not shown) operating the rollers causes the lower surfaces of the belts to move in a direction D which is inclined, in the horizontal plane, to the direction leading from the mouth 6 to the transport belts 10, as shown more clearly in FIG. 2.

A fan 16 is located above the alignment belts 12 and is operable to produce an upward air flow in the direction A shown in FIG. 1 when the fan is activated.

The inlet 2 is provided with a guide surface 18 which extends upwardly along one side of the path 8 and is aligned with the intended orientation and direction of movement of the banknotes to be delivered to the transport belts 10.

Figure 4:
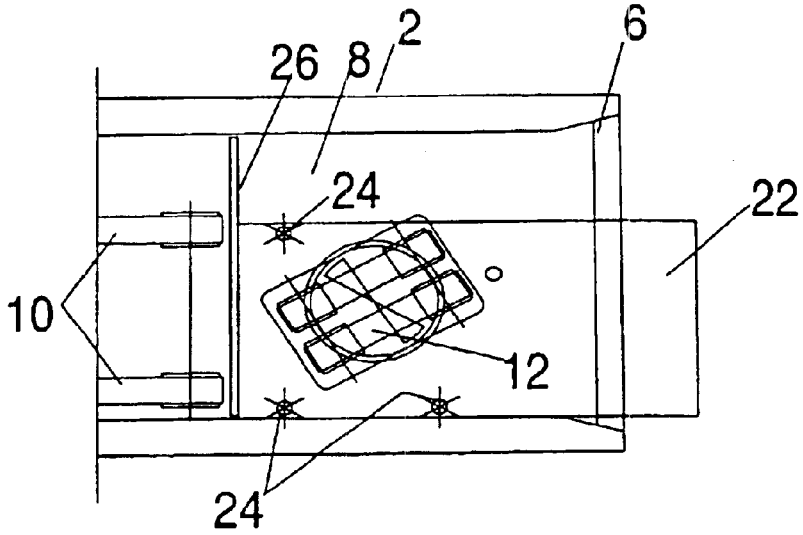

The inlet is also provided with a number of sensors. Each sensor comprises a light emitter/receiver pair having a light path extending in a substantially vertical direction across the path 8. A first sensor 20 is intended to detect the arrival of a manually-inserted banknote 22 as shown in FIG. 2. Three further sensors 24 are intended to detect an aligned bill which has reached a position close to the transport belts 10, as shown in FIG. 4.

Figure 5:
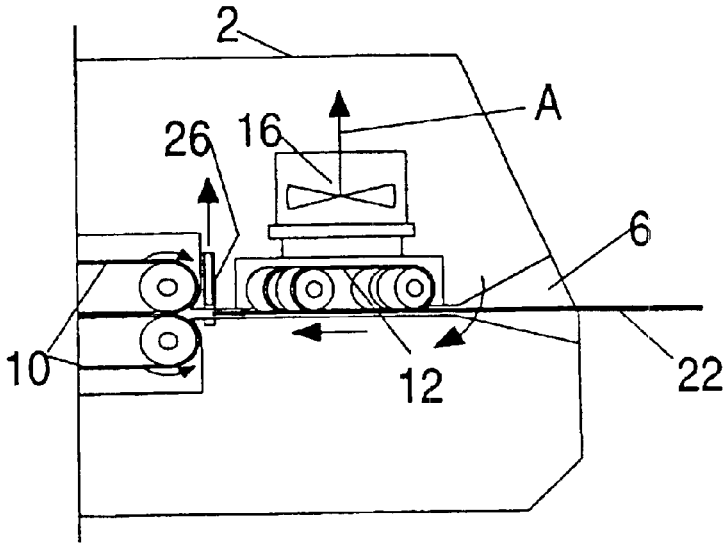

A gate 26 is located in front of the transport belts 10 and prevents access to the belts until the gate is moved upwardly as shown in FIG. 5.

The operation of the apparatus is as follows. In an initial state, neither the fan 16 nor the drive belts 12 are activated. As soon as the manually inserted banknote 22 has been detected by the sensor 20, as shown in FIG. 1, both the fan 16 and the drive belts 12 are set in operation.

Figure 3:
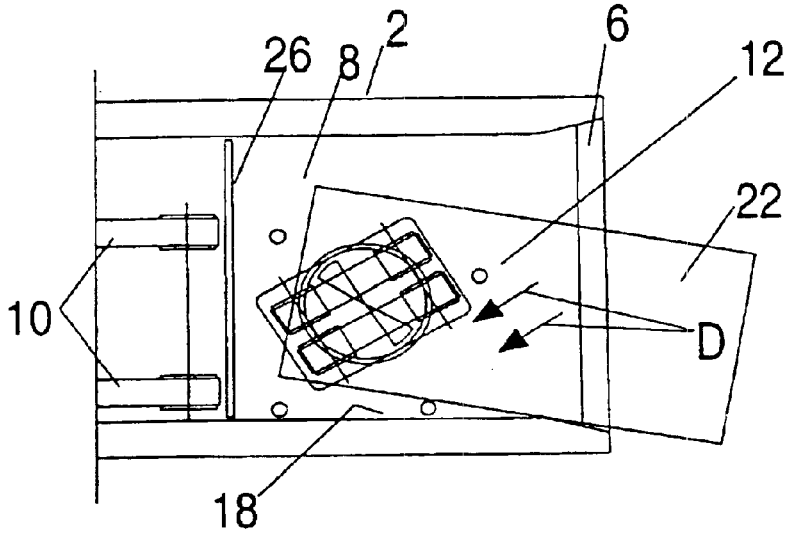

As the banknote is pushed further into the path 8 of the inlet 2, the reduced pressure on the top face of the banknote causes the banknote to be lifted into engagement with the belts 12. These tend to shift the banknote in the direction D (see FIG. 3) so that the banknote moves both inwardly towards the belts 10 and towards the guide surface 18.

The banknote will then tend to rotate about an axis which is substantially perpendicular to its plane as it is moved further by the belts 12 so that it reaches the aligned position shown in FIG. 4. There is little resistance to this rotational movement because relatively low forces are used to cause the banknote to engage the belt 12.

Figure 6:
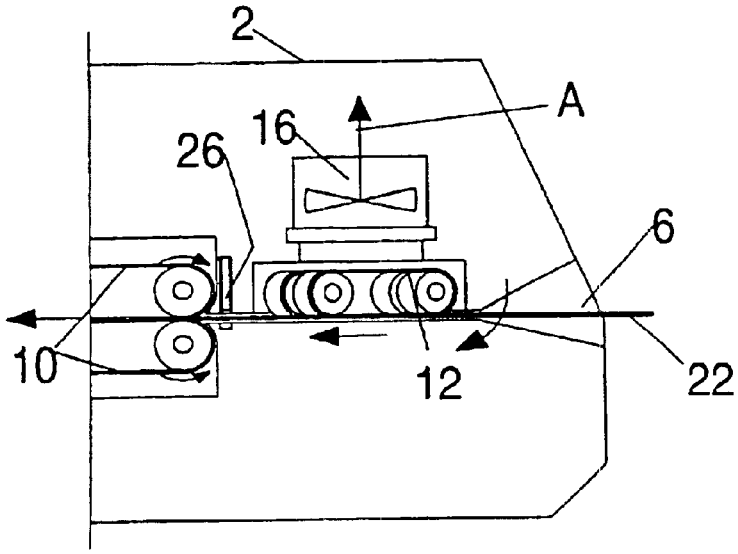

Once alignment of the banknote has been detected as shown in FIG. 4, the gate 26 is lifted as shown in FIG. 5 and the transport belts 10 start to move. Continued movement of the banknote 22 will cause the leading edge of the banknote to be gripped between the belts 10, as shown in FIG. 6, which can then transport the banknote to the validator. The gate 26 can then be lowered and the fan 16 and belts 12 deactivated.

The lower surface of the path 8 is preferably provided with apertures to permit free flow of air vertically upwardly across the path 8.

Preferably, the maximum area (either a single continuous area or the total of a number of discrete areas) over which the reduced pressure is applied by the air current generating means (i.e. the fan 16 in the above embodiment) to the banknote is equal to at least 30 percent of the surface area of the banknote, and more preferably is greater than 75 percent of the area of the banknote, at least for some banknote denominations. The large area means that the force per unit area can be relatively small, so that there is little resistance to rotation of the banknote.

In an alternative embodiment, instead of applying reduced pressure to one face of the banknote in order to attract it, increased pressure could be applied to repel the banknote so that it engages the drive mechanism. However, this alternative arrangement is more likely to encounter problems due to turbulence.

Figure 7:
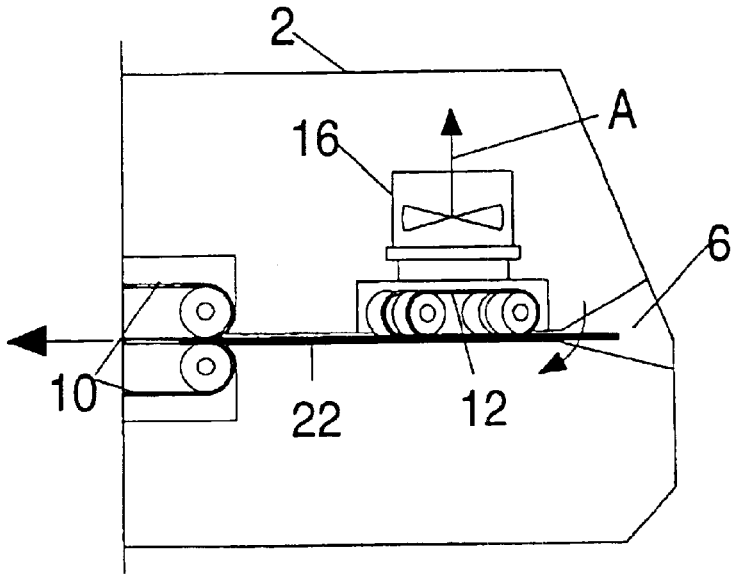
FIG. 7 is a schematic side view of a modified embodiment of the alignment apparatus.

FIG. 7 is a schematic side view of a modified embodiment which omits the gate 26. The belt 10 could be arranged to move continuously, or in response to an output from the sensor 20. In this embodiment, the transport of the banknote 22 occurs continuously, while the banknote is being aligned. There is a greater distance between the drive belts 10 and the alignment belts 12 to ensure the banknote has sufficient time to become aligned correctly before reaching the drive belts 10.

Figure 8:
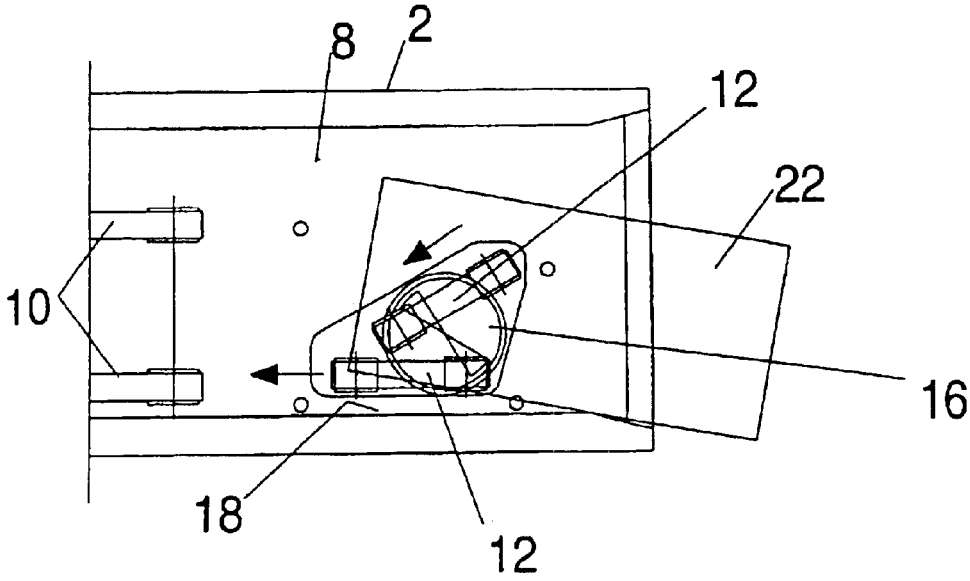
FIGS. 8, 9 and 10 are plan views of respective further embodiments.

FIG. 8 is a plan view showing a further modification, in which one of the belts 12 extends in the direction leading directly to the transport belts 10, and the other extends in the inclined direction D to transport the note towards the guide surface 18.

Figure 9:
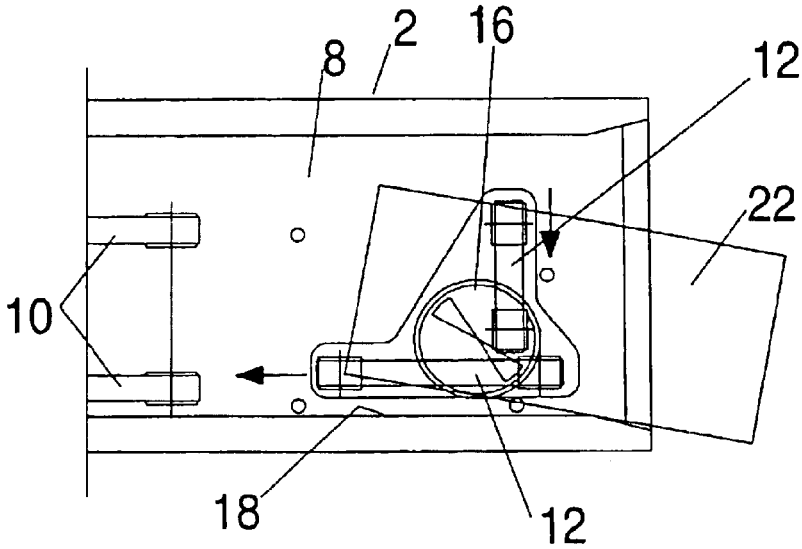

FIG. 9 shows a further modification in which one of the belts 12 extends parallel to the guide surface 18 to drive the banknote towards the belts 10, and the other extends in a substantially perpendicular direction to the belt and moves directly towards the guide surface 18.

Figure 10:
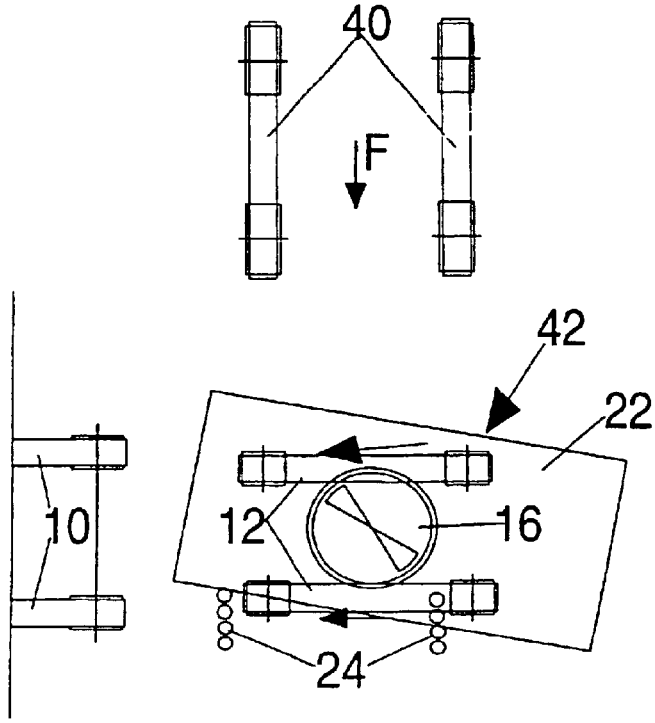

FIG. 10 shows a further embodiment, in which a first pair of drive belts 40 drives a banknote in the direction of arrow F to an alignment station 42. The belts 12 at the alignment station can be driven independently at different speeds so that the banknote 22 can be rotated while remaining at the alignment station 42. In this arrangement, there is no guide surface 18. Instead, rows of sensors 24 are used to detect the alignment of an edge of the banknote 22, the outputs being used to control the differential movement of the belts 12. Accordingly, the banknote is rotated until it is correctly aligned, before being transported by the belts 12 to the drive belts 10.

Each of the features mentioned above in respect of each of the described embodiments may be used in conjunction with the other embodiments. Various further modifications are possible. For example, the belts 12 of the alignment mechanism are not essential. The banknote could be driven directly by rollers. Alternatively, the belts 12 could be replaced by a wheel having a high coefficient of friction and rotating about an axis normal to the plane of the banknote, to cause the banknote to rotate. Supplementary alignment means may be provided. It may in some circumstances be desirable to control the power of the fan, for example in accordance with the characteristics of the banknote (e.g. its stiffness or coefficient of friction), or in response to a sensor which detects movement of the banknote. The illustrated embodiments may be re-oriented; for example, the fan may be positioned below the banknote path, rather than above it.

What is claimed is:

1. Apparatus for aligning a banknote, the apparatus comprising:

a drive arrangement having a part which frictionally engages a banknote to move the banknote so as to cause rotation of the banknote relative to the drive arrangement part; and means for generating an air current sufficient to cause the banknote to engage the part of the drive arrangement with enough force to allow the banknote to be driven thereby while the banknote is being rotated.

2. The apparatus of claim 1, wherein the drive arrangement comprises guide means and drive means arranged to drive the banknote so that an edge thereof engages the guide means to cause the edge to become aligned with the guide means.

3. The apparatus of claim 1 or claim 2, wherein the air current generating means is operable to reduce the air pressure at one face of the banknote.

4. The apparatus of claim 1 including a sensor to sense when the banknote is aligned with a predetermined direction.

5. The apparatus of claim 4, including means for opening a gate to permit transportation of the banknote in response to sensing alignment thereof.

6. The apparatus of claim 4 or 5, including means for controlling the drive arrangement so that rotation of the banknote is stopped in response to sensing of the alignment of the banknote.

7. The apparatus of claim 1 including means for initiating at least one of (a) the operation of the drive arrangement and (b) the generation of the air current in response to sensing the arrival of a banknote to be aligned.

8. Apparatus as claimed in claim 1, wherein the drive arrangement comprises at least one movable belt arranged to engage the banknote.

9. Apparatus as claimed in claim 1, wherein the drive arrangement comprises at least one roller arranged to engage the banknote.

10. Banknote handling apparatus comprising a transport mechanism for transporting a banknote, an inlet by means of which a banknote can be manually supplied to the banknote apparatus, and aligning apparatus as claimed in claim 1 for aligning the manually inserted banknote and providing the aligned banknote to the transport means.

* * * * *